US012535289B2

(12) United States Patent
Freeman

(10) Patent No.: US 12,535,289 B2
(45) Date of Patent: Jan. 27, 2026

(54) FIREARM HANDGUARD ATTACHMENT

(71) Applicant: Magpul Industries Corp., Austin, TX (US)

(72) Inventor: Zachary Freeman, Westminster, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/763,548

(22) Filed: Jul. 3, 2024

(65) Prior Publication Data

US 2025/0012542 A1 Jan. 9, 2025

Related U.S. Application Data

(60) Provisional application No. 63/512,498, filed on Jul. 7, 2023.

(51) Int. Cl.
*F41C 23/16* (2006.01)
*F41C 7/06* (2006.01)

(52) U.S. Cl.
CPC ..... *F41C 23/16* (2013.01); *F41C 7/06* (2013.01)

(58) Field of Classification Search
CPC ..... F41C 23/16
See application file for complete search history.

(56) References Cited

U.S. PATENT DOCUMENTS 2,826,848 A * 3/1958 Davies ..... F41C 23/16 42/71.01
7,454,858 B2 * 11/2008 Griffin ..... F41G 1/35 42/72
8,215,046 B2 7/2012 Chvala
8,578,642 B2 11/2013 Troy et al.
(Continued)

FOREIGN PATENT DOCUMENTS

EP 2166301 A2 3/2010
ES 2549438 T3 10/2015
(Continued)

OTHER PUBLICATIONS

"LASAI Marlin and Henry Rail Interface", Hoptic USA, 1 page, online available at, Known as early as Aug. 2, 2023.
(Continued)

*Primary Examiner* — Jonathan C Weber
(74) *Attorney, Agent, or Firm* — NOD Law PC

(57) ABSTRACT

A firearm is provided that comprises a barrel, a magazine tube below the barrel, and a handguard with first and second portions. A clamp between the handguard portions has a main body with deformable lugs and a fastener. The handguard's first portion features an arcuate surface for the barrel and a bore for the magazine tube. The lugs move inward and downward, securing the handguard. The clamp is positioned within a recess between the handguard portions. Fasteners are accessible through apertures in the handguard. The clamp contacts both the magazine tube and the barrel when tightened. The clamp includes a main body and deformable
(Continued)

lugs, with a fastener to secure the handguard. The lugs are deformable, made of various materials, and designed to bend upon tightening. The method involves positioning and tightening the clamp to deform the lugs and secure the handguard.

16 Claims, 20 Drawing Sheets

(56) References Cited

U.S. PATENT DOCUMENTS

| | | | | |
|---|---|---|---|---|
| 8,656,621 | B2 | 2/2014 | Chvala | |
| 9,228,804 | B2 | 1/2016 | Syrengelas et al. | |
| 9,453,694 | B1 | 9/2016 | Storch | |
| 9,494,382 | B2 | 11/2016 | Storch | |
| 9,897,410 | B1 | 2/2018 | Tarip | |
| D835,745 | S | 12/2018 | Storch | |
| 10,184,753 | B2 | 1/2019 | Krebs | |
| D840,494 | S | 2/2019 | Storch | |
| D844,091 | S | 3/2019 | Kincel et al. | |
| D846,688 | S | 4/2019 | Storch | |
| D865,111 | S | 10/2019 | Storch | |
| D893,660 | S | 8/2020 | Storch | |
| 10,962,324 | B1 * | 3/2021 | Ding | F41G 11/004 |
| 2006/0191183 | A1 * | 8/2006 | Griffin | F41C 23/16 42/72 |
| 2010/0269392 | A1 | 10/2010 | Swan | |
| 2014/0157639 | A1 | 6/2014 | Larson, Jr. | |
| 2022/0128331 | A1 | 4/2022 | Kincel et al. | |
| 2022/0196364 | A1 | 6/2022 | Underwood et al. | |

FOREIGN PATENT DOCUMENTS

| | | | | |
|---|---|---|---|---|
| WO | WO-2005017439 | A2 * | 2/2005 | F41C 23/16 |
| WO | WO-2005019762 | A2 * | 3/2005 | F41C 23/16 |
| WO | WO-2009131721 | A2 * | 10/2009 | F41G 11/003 |

OTHER PUBLICATIONS

"Lever-Action Rifles", Marlin, 2 pages, online available at , Known as early as Aug. 2, 2023.

"Marlin Handguard Installation Instructions", Midwest Industries Inc., 1 page, online available at , Known as early as Aug. 2, 2023.

"Marlin M-LOK Handguard | End Cap Models (Black) | Mlok Rails", Ranger Point Precision, 3 pages, online available at , Known as early as Aug. 2, 2023.

"Marlin® M-Lok Handguard", Midwest Industries Inc., 2 pages, online available at , Known as early as Aug. 2, 2023.

* cited by examiner

FIREARM HANDGUARD ATTACHMENT

CLAIM OF PRIORITY UNDER 35 U.S.C. § 119

The present application for patent claims priority to Provisional Application No. 63/512,498, entitled "Firearm Handguard Attachment," filed Jul. 7, 2023 and assigned to the assignee hereof and hereby expressly incorporated by reference herein.

FIELD OF THE DISCLOSURE

The present disclosure relates generally to firearm handguards. In particular, but not by way of limitation, the present disclosure relates to systems, methods and apparatuses for attaching a handguard to a firearm.

DESCRIPTION OF RELATED ART

Many long guns, such as rifles and shotguns, include two gunstock portions, e.g., a buttstock or shoulder stock portion, located at the rear end of the gun, which the shooter grasps with one hand and places against a shoulder during the aiming and firing of the gun, and a handguard (also referred to as forend) portion, which is typically located below the barrel of the gun and ahead of its receiver, which the shooter grasps with the other hand and uses to support the barrel and to traverse it in azimuth and elevation, i.e., to aim the gun. In some guns, e.g., lever action firearms, a manually operated cocking handle is located around (or incorporated into) the trigger guard area. The cocking handle can pivot forward to move the bolt via internal linkages, which will feed and extract cartridges into and out of the chamber and cock the firing pin mechanism. The market has seen offerings of a number of handguards, including accessory-mounting handguards, for both handguns and long guns.

Some prior art handguards are not without drawbacks. For example, some are made from wood, and various properties of a wooden material limit its functionality. Also, it is desirable to have speed and simplicity for installing handguards that can have improved functionality (e.g., a lower profile, improved styling, an improved grip, an improved ability to attach various accessories, etc.). Thus, an improved user experience for installing handguards is desired.

BRIEF SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as a firearm comprising a barrel, a magazine tube disposed below the barrel, and a handguard configured to be mounted adjacent to both the barrel and the magazine tube. The handguard includes a first portion and a second portion, with a clamp positioned between them. The clamp has a main body positioned within a recess formed between the first and second portions of the handguard. Extending from the main body are at least one pair of projecting deformable lugs, each having an upper end. The clamp also includes at least one fastener, which is configured to tighten into the main body. This tightening action causes the upper ends of the deformable lugs to move closer together, decreasing the distance between them. When the fastener is tightened, the upper ends of the lugs are positioned between a concave inner surface of the handguard and the magazine tube, eventually contacting the magazine tube to secure the handguard in place.

In some embodiments, the first portion of the handguard has a substantially arcuate upper surface that conforms to the lower surface of the barrel. The upper ends of the projecting deformable lugs are cylindrical in shape and are designed to move inward and downward upon tightening of the fastener. This movement brings the lugs into contact with the magazine tube, securing the handguard to the firearm. Additionally, the first portion of the handguard may include a longitudinal bore that is sized to receive the magazine tube. The projecting deformable lugs of the clamp extend through the first portion, placing the upper ends of the lugs inside the concave inner surface of the handguard.

In other embodiments, the handguard itself is composed of a first and second portion, where the first portion features a concave inner surface that is shaped to conform to the lower surface of the barrel. The second portion is designed to couple with the first portion. The main body of the clamp fits into a recess that is formed between these two portions of the handguard. The second portion of the handguard includes angled portions that have a first edge and a second edge, defining an angle. The upper ends of the projecting deformable lugs are positioned between these edges, allowing for inward and downward movement when the fastener is tightened, which engages the angled portions.

The fastener is accessible through clearance apertures in the handguard, enabling the fastener to be tightened after the clamp is in position within the handguard and the handguard is mounted on the firearm. The projecting deformable lugs are designed to contact both the magazine tube and the barrel when the fastener is tightened, facilitating a secure attachment of the handguard to the firearm.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
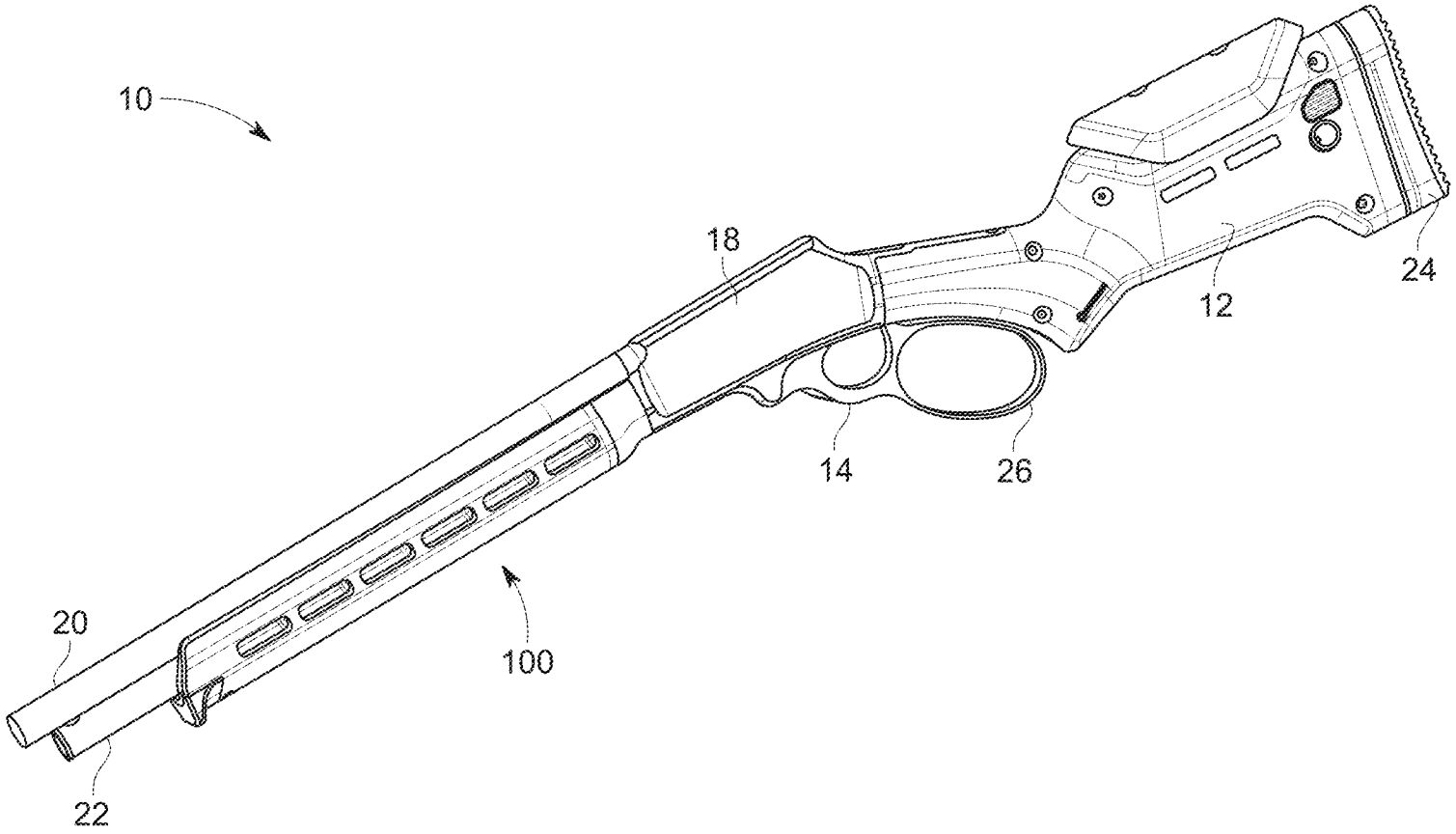
FIG. 1 is an upper, front, left-side perspective illustrative view of a firearm incorporating an example embodiment of a firearm handguard.

The present disclosure relates generally to a firearm handguard. More specifically, but without limitation, the present disclosure relates to systems, methods and apparatuses for attaching a handguard to a firearm.

The word "exemplary" is used herein to mean "serving as an example, instance, or illustration." Any embodiment described herein as "exemplary" is not necessarily to be construed as preferred or advantageous over other embodiments.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items, and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 2:
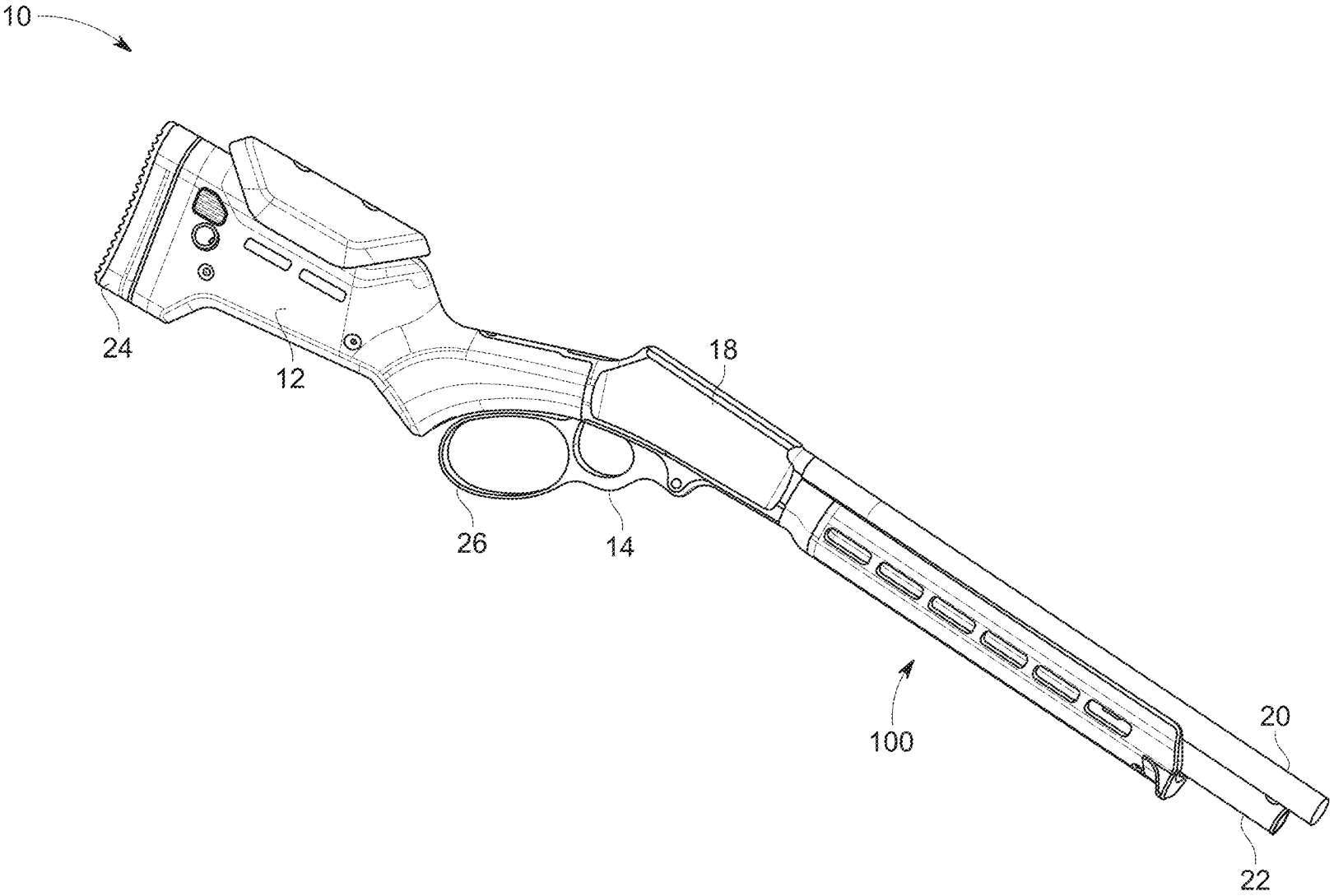
FIG. 2 is an upper, front, right-side perspective illustrative view of the firearm and example embodiment of the handguard of FIG. 1.
Figure 3A:
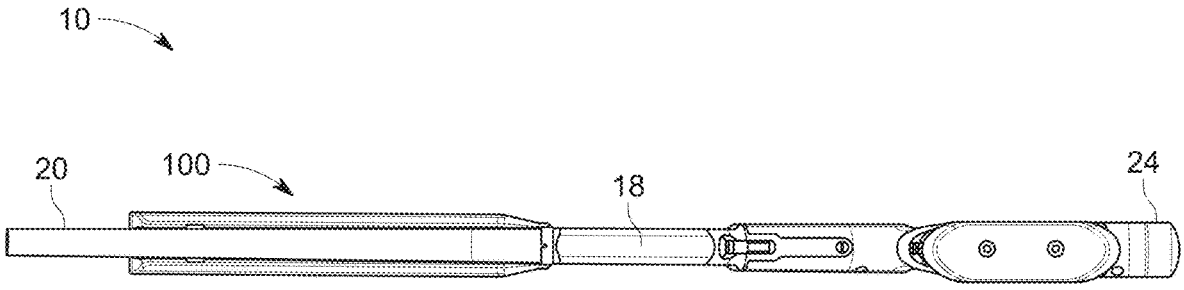
FIGS. 3A-3D are, respectively, top plan, left-side elevation, bottom plan, and right-side elevation illustrative views of the firearm and example embodiment of the handguard.
Figure 3B:
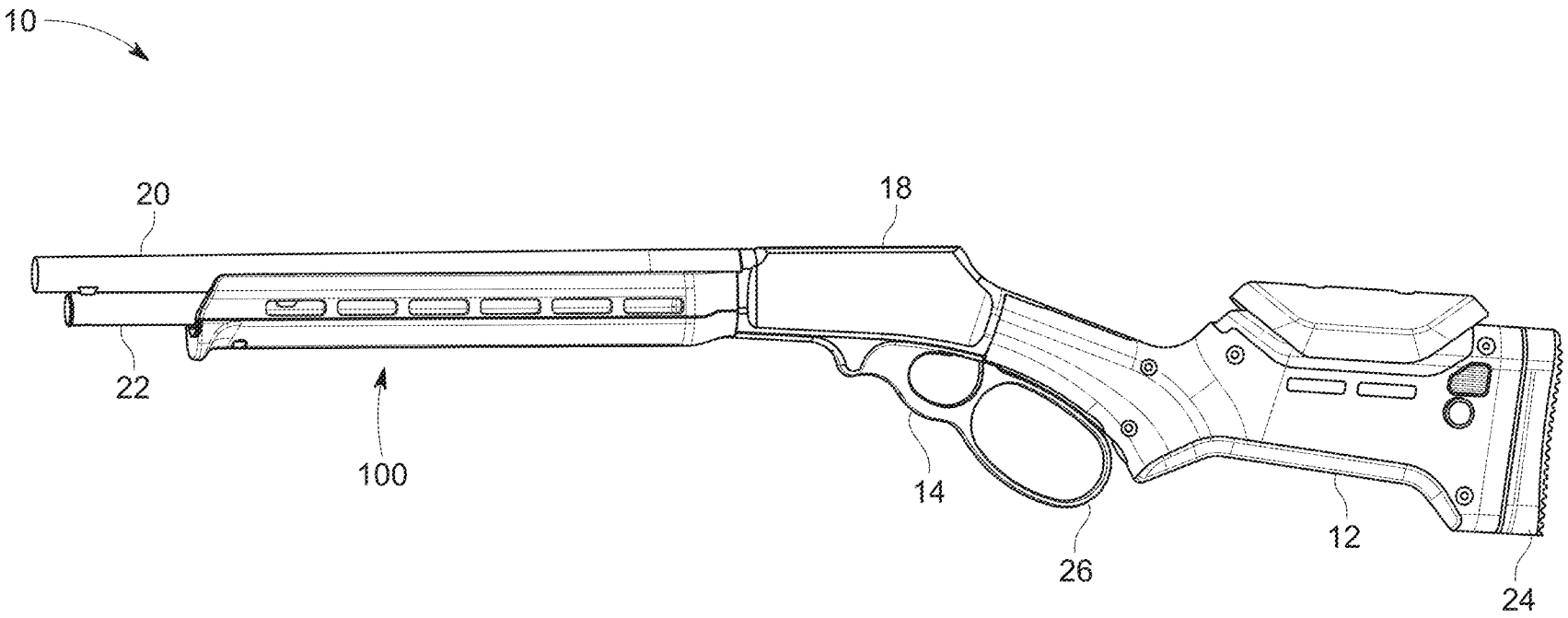
Figure 3C:
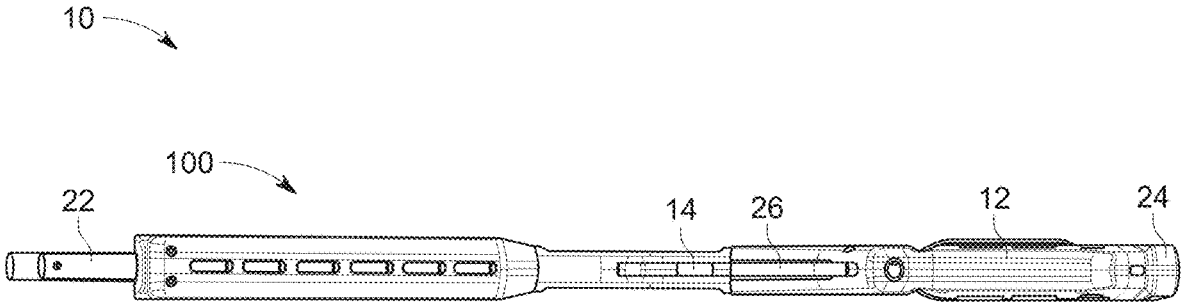
Figure 3D:
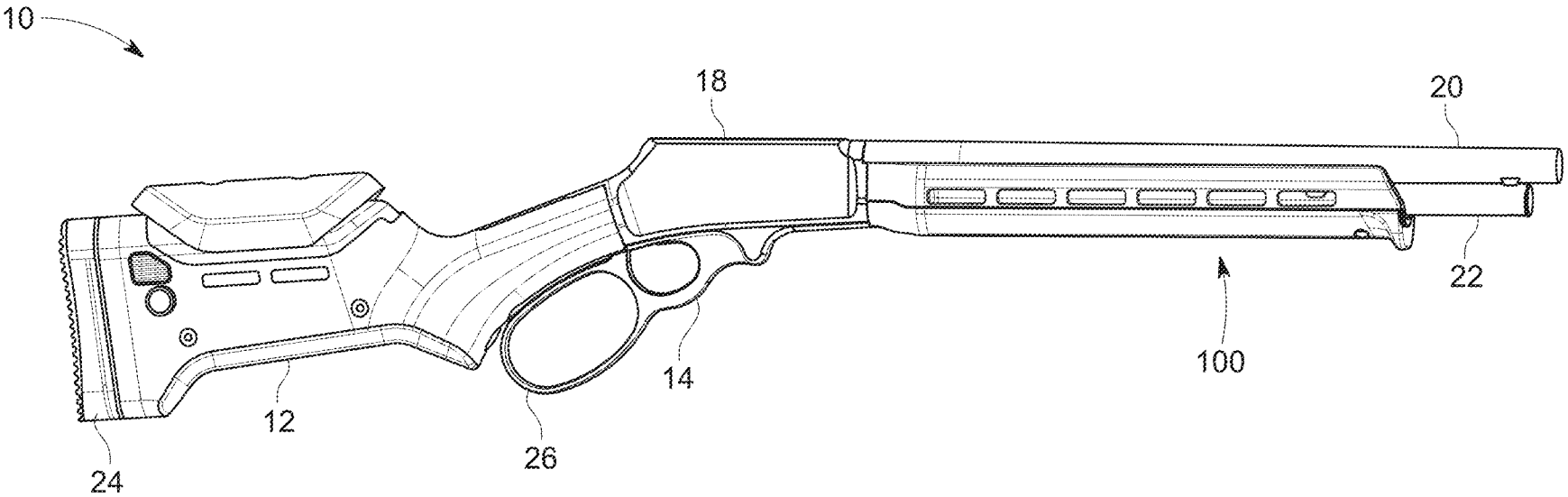

FIG. 1 is an upper, front, left-side perspective illustrative view of an example firearm 10 incorporating an example embodiment of a firearm handguard 100. FIG. 2 is an upper, front, right-side perspective illustrative view of the firearm and example embodiment of the handguard of FIG. 1. FIGS. 3A-3D are, respectively, top plan, left-side elevation, bottom plan, and right-side elevation illustrative views of the firearm 10 and example embodiment of the handguard 100.

In the particular embodiments of FIGS. 1, 2 and 3A-3D, the firearm 10 comprises a lever-action firearm, but it should be understood that the embodiments of handguards 100 including handguard attachment components described herein are also suitable for use with other types of firearms, such as, but not limited to, single shot, pump action, semi-automatic and fully automatic rifles, shotguns, pistols or handguns, machine guns, machine pistols, and the like. Handguard attachment components may be fully or partially incorporated into components of the handguard, and may include one, some, or all of various attachment mechanisms such as a clamp and fastener(s). Some attachment mechanisms may provide advantageous properties over others, as disclosed herein.

As illustrated in FIGS. 1 and 2, the example firearm 10 comprises a shoulder stock 12, a trigger guard 14 for guarding a trigger (not shown), a lever 26 for manually cocking the firearm 10, a receiver 18, a handguard 100, and an elongated, generally cylindrical barrel 20 and tubular magazine 22 (also referred to as a magazine tube) protruding forwardly from a front end of the receiver 18. It should be noted that the magazine 22 could have other shapes, including but not limited to, octagonal. As illustrated, in some embodiments, a recoil pad 24 can be disposed at a rear end of the buttstock (also referred to as a shoulder stock) 12, and in other embodiments, the firearm 10 can include a fixed front sight (not shown) and an adjustable rear sight (not shown), e.g., a dispart or peep sight, useful for aiming the firearm 10.

The various features illustrated in FIGS. 1, 2 and 3A-D are not limited to any particular embodiment. For example, in some embodiments, the shoulder stock 12 is configured in various shapes and sizes, tailored for comfort and ergonomics. In some embodiments, the shoulder stock 12 is adjustable to accommodate different shooter preferences and body sizes. In some embodiments, the trigger guard 14 is integral to the firearm 10, while in other embodiments, it is configured as a separate piece. In some embodiments, such as those on tactical firearms, the trigger guard 14 is enlarged to allow for use with gloves. In many embodiments, the lever 26 is located beneath the receiver 18 and requires the user to swing it downward and then back up to its original position, which chambers a round and cocks the hammer for firing. However, in other embodiments, the lever is located in a different location and/or does not require the same mechanism for loading and/or firing.

In some embodiments, the receiver 18 is configured as an integral piece of the firearm 10, while in other embodiments, the receiver 18 is configured to be detachable. In many embodiments, the barrel 20 is configured with various grooves, while in other embodiments, the barrel is smoothbore. In some embodiments, the length of the barrel 20 is based upon the intended use of the firearm 10. For example, in some embodiments requiring greater accuracy, velocity, or range, the barrel 20 may be elongated.

In some embodiments, the tubular magazine 22 is configured to hold ammunition in a line. In other embodiments, different ammunition configurations are used. In some embodiments, the magazine 22 does not act as a magazine as all, but instead rounds may be stored in a box magazine such as seen in common AR style platforms, and the magazine 22 structure may have other functionality, such as related to the pump action of a firearm. In other words, the magazine 22 need not always be a repository for additional cartridges. In many embodiments, ammunition is pushed into the chamber of the magazine using a spring mechanism. However, other methods of moving ammunition to the chamber of the magazine are contemplated herein.

With reference to FIGS. 4A-4E, additional embodiments of a handguard 100 and a clamp 200 are provided. As illustrated in these figures, in some embodiments, the handguard 100 comprises a first portion 140 and a second portion 144 (sometimes referred to as lower portion 144) that are configured to mount at least partially below the barrel and against the magazine tube (e.g., generally cylindrical barrel 20 and tubular magazine 22, respectively, as illustrated in FIGS. 1-3D). In some embodiments, the second portion 144 couples to one or more surfaces (e.g., one or more lower surfaces, side surfaces, and/or other surfaces) of the first portion 140. In some embodiments, the first portion 140 and/or second portion 144 comprises one or more external surfaces, such as a grip, configured to be grasped by a palm, fingers, and/or thumb of a user's hand (e.g., by being smooth, rough, and/or recessed, among other grip surface options). Such configurations may permit the user to conveniently hold firearm 10 and/or handguard 100 (e.g., to pull handguard 100 back towards the user). In some embodiments, the first and second portions 140, 144 are a single unified component. In other embodiments, the first and second portions 140, 144 are constructed in two parts to ease manufacturing and/or cleaning processes.

As illustrated in FIGS. 4A-4E, in some embodiments, the first portion 140 comprises a substantially arcuate upper surface 106 (also referred to as a concave inner surface of the handguard) that substantially conforms to a portion of a lower portion of the barrel 20 of the firearm 10, and a longitudinal bore 108 configured to receive the tubular magazine 22 of the firearm 10 disposed concentrically therein (see, e.g., FIGS. 7A-7E). In some embodiments, the upper surface 106 contacts sides of the barrel 20 and/or lower sides of the barrel 20. Typically, the lower surface of the barrel 20 is adjacent to and/or in contact with the magazine 22 and thus does not contact the upper surface 106.

Figure 4A:
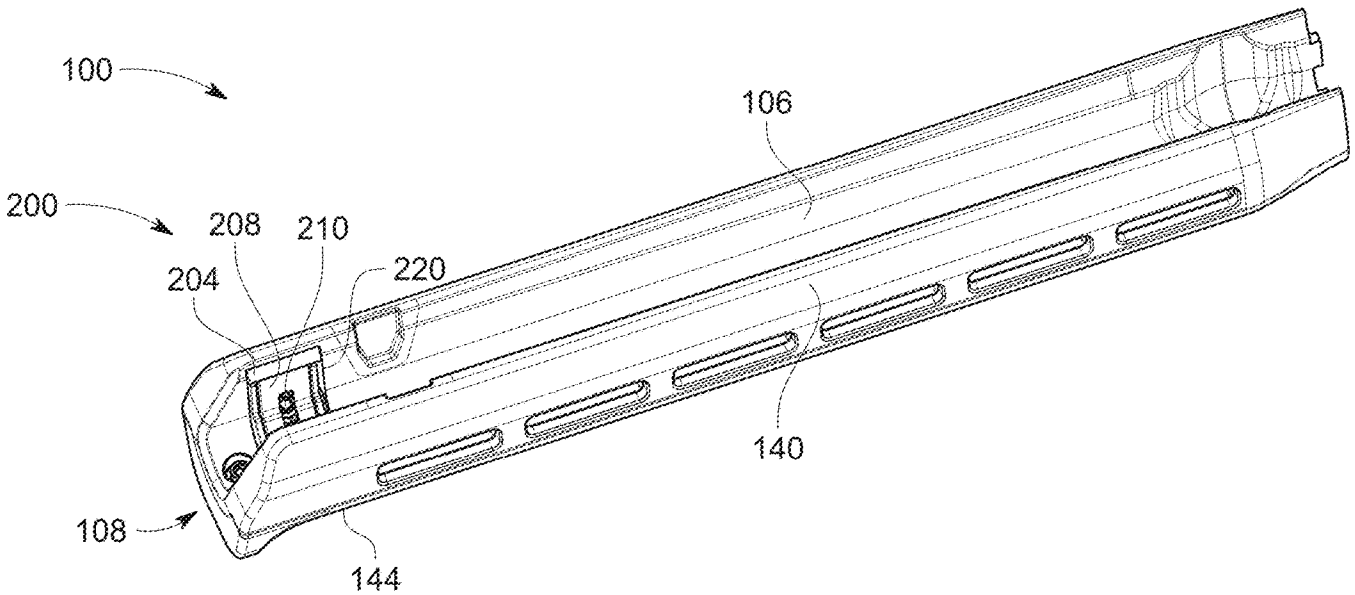
FIGS. 4A-4E are, respectively, upper front left-side perspective, top plan, left-side elevation, bottom plan, and right-side elevation illustrative views of a handguard and example embodiment of a clamp.
Figure 4B:
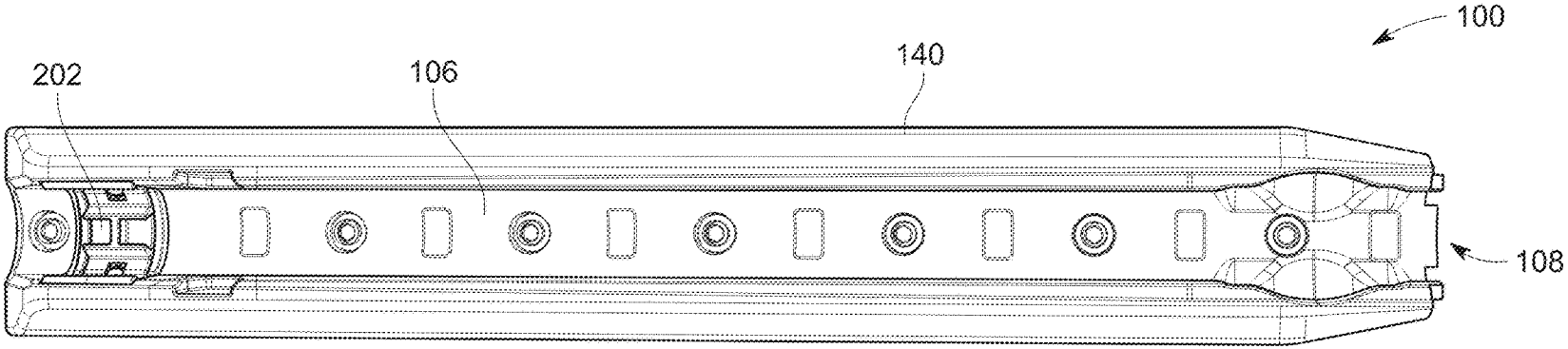
Figure 4C:
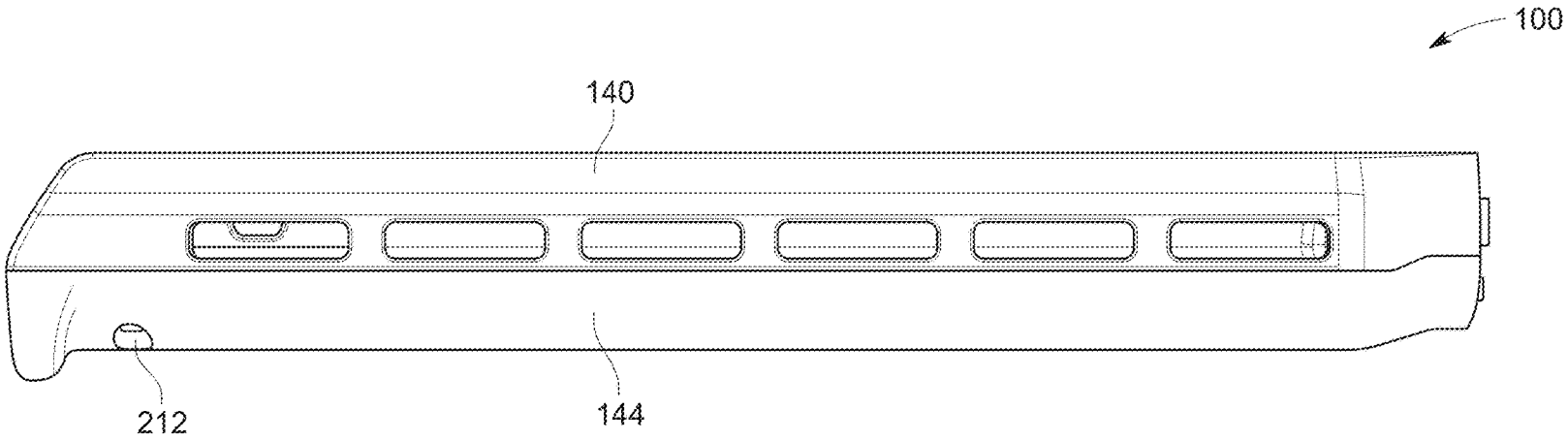
Figure 4D:
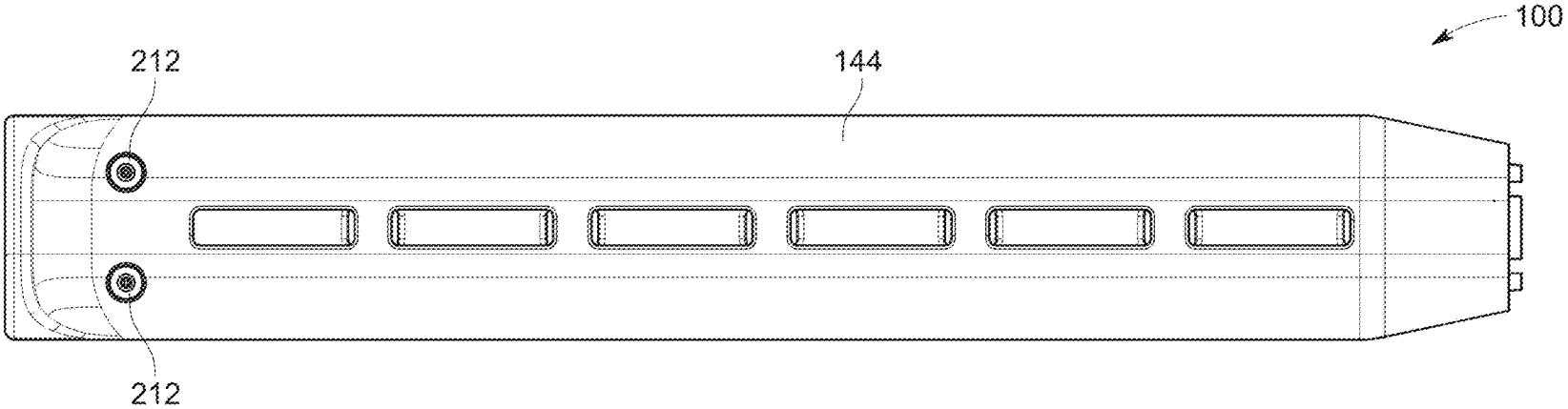
Figure 4E:
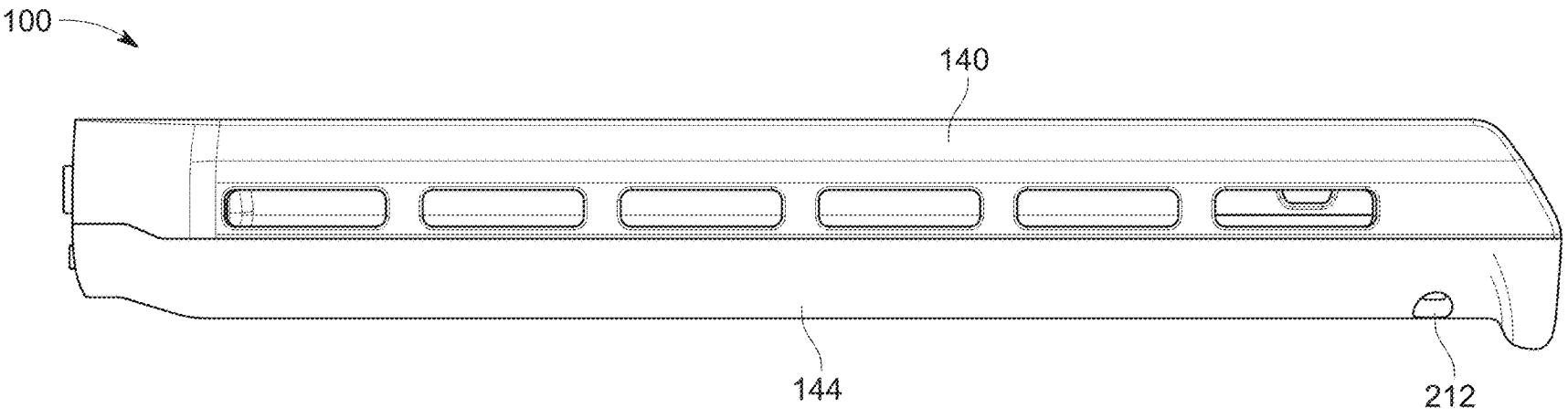
Figure 5A:
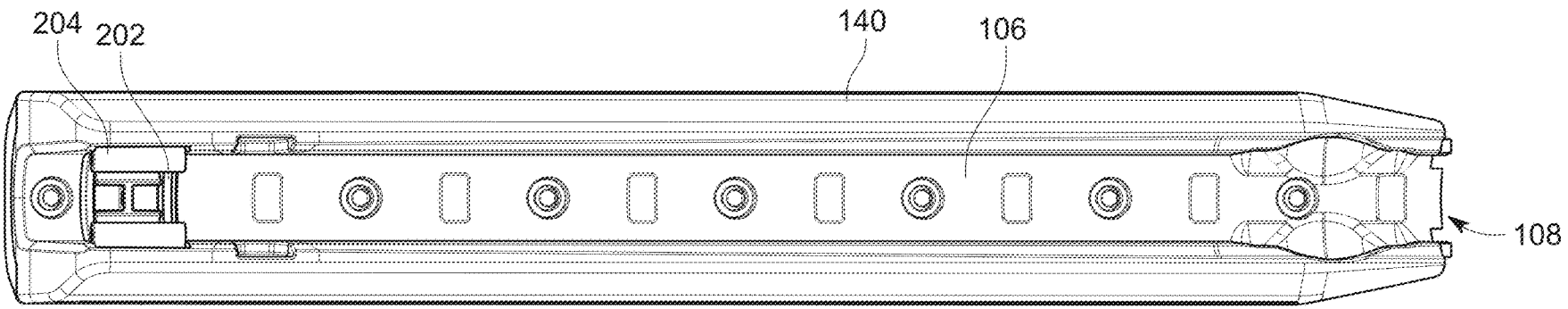
FIGS. 5A-5D are, respectively, top plan, left-side elevation, bottom plan, and right-side elevation illustrative views of a first portion of a handguard and example embodiment of a clamp.
Figure 5B:
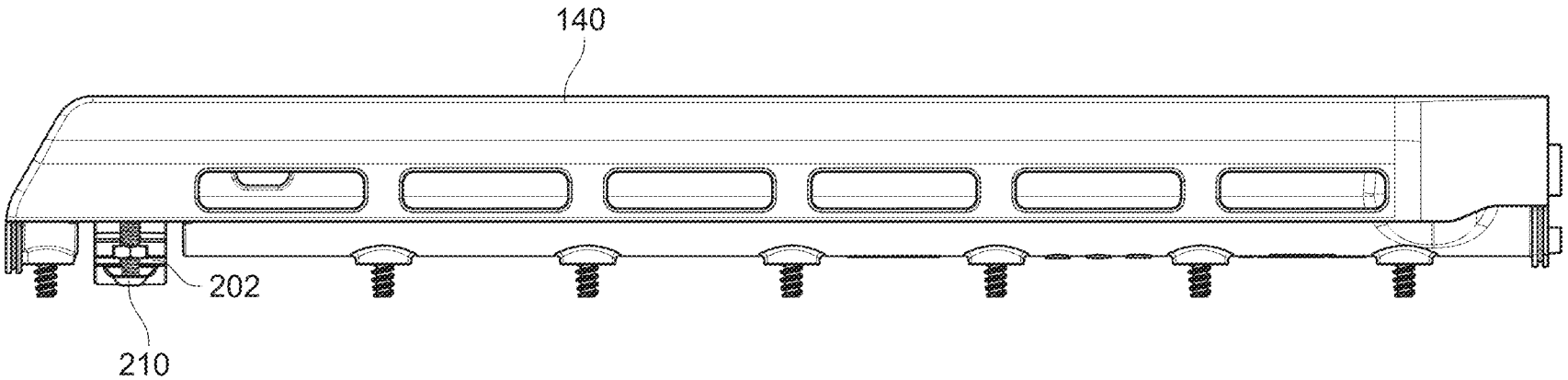
Figure 5C:
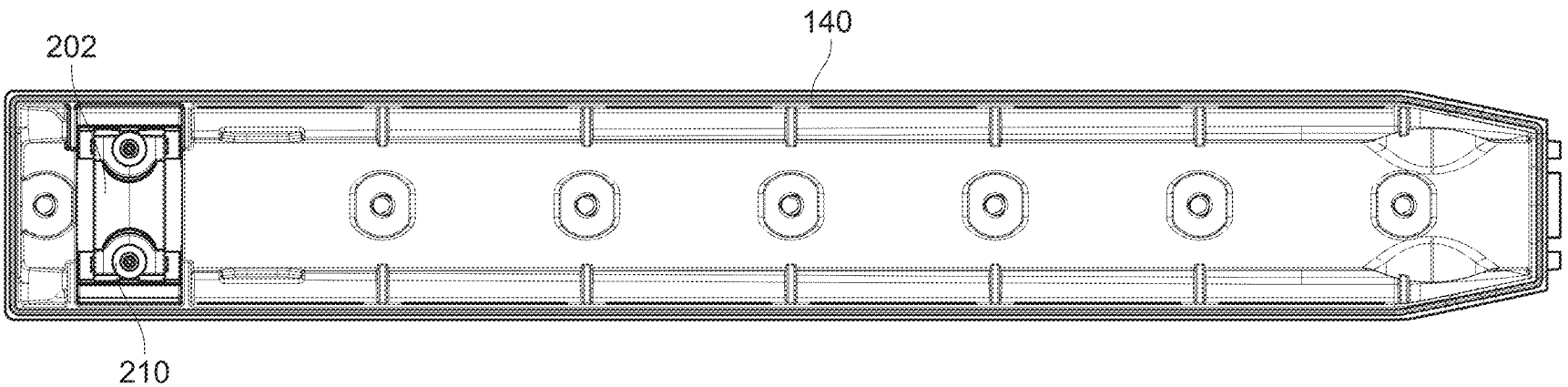
Figure 5D:
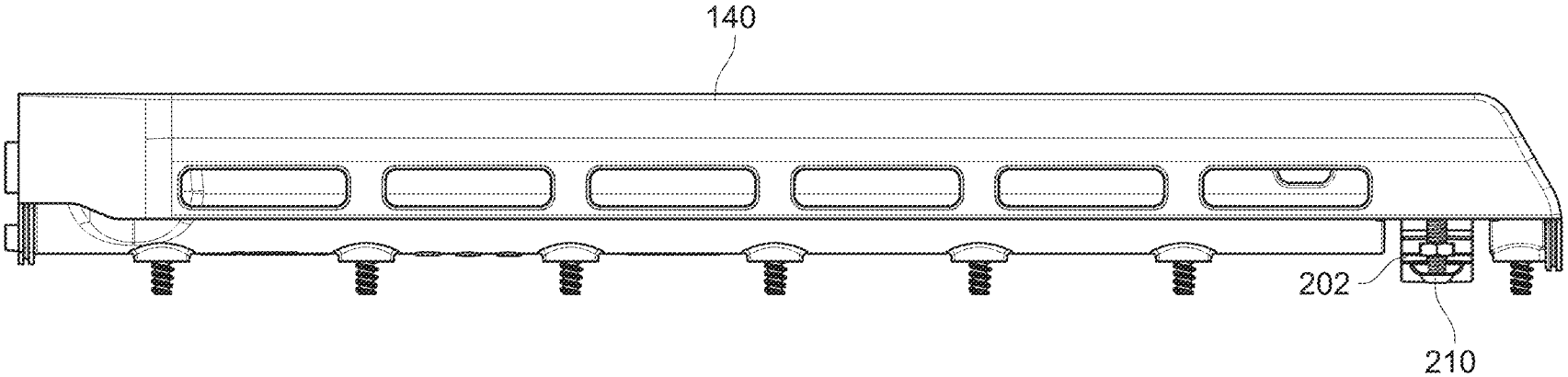
Figure 5E:
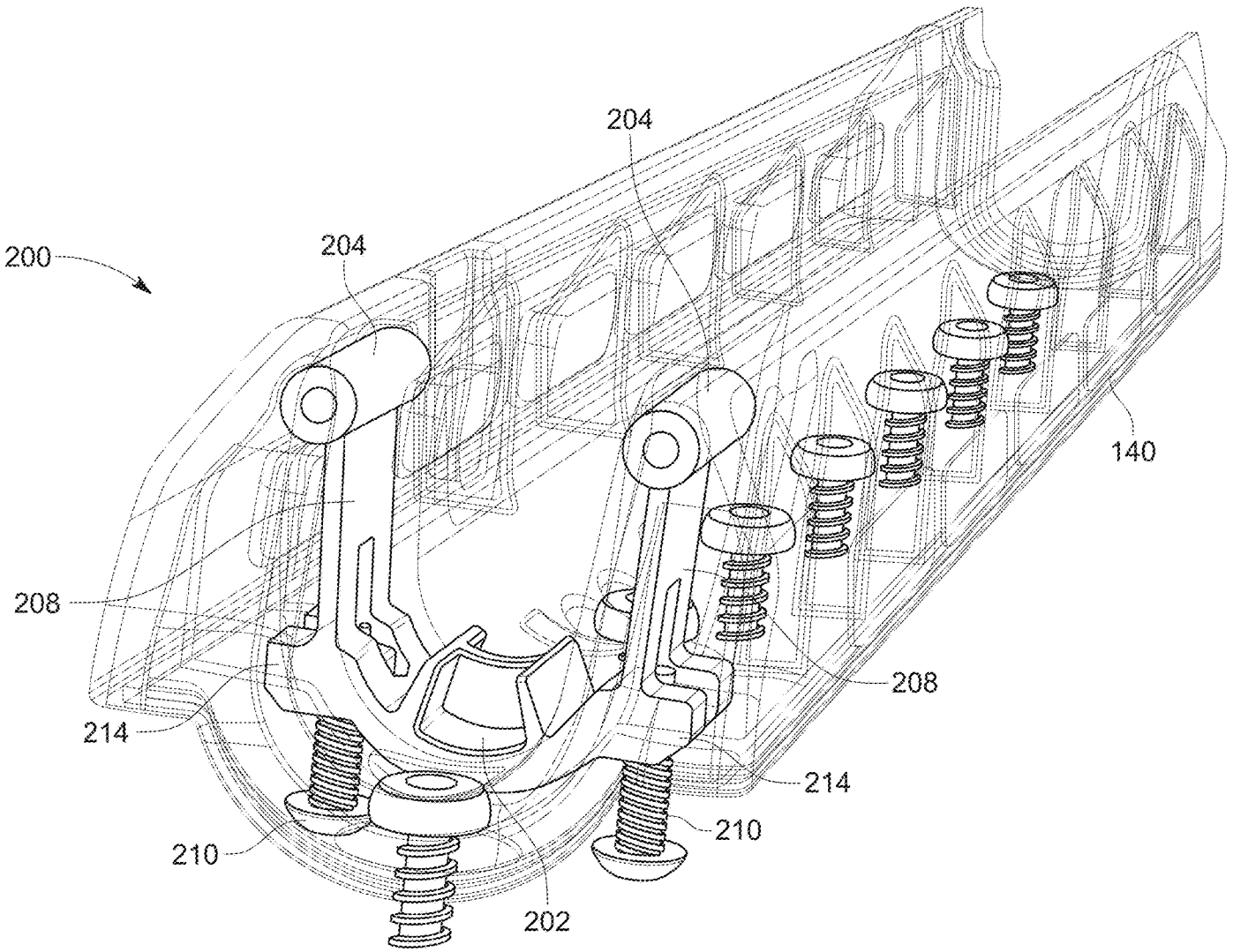
FIG. 5E is an upper front left-side perspective illustrative view of a transparent first portion of the handguard and example embodiment of a clamp as shown in FIGS. 5A-5D.

An example embodiment of a clamp 200 is also shown in FIGS. 4A-4E. In some embodiments, the clamp 200 has a main body (not shown in FIGS. 4A-4E) with at least one pair of projecting deformable lugs 208 extending from the main body (e.g., lugs that include deformable arms where the deformable arms extend from the main body to the upper end 204 of each of the lugs 208, for instance as seen in FIG. 5E). For example, at least some portions of one or more of the main body 202 and the projecting deformable lugs 208 are positioned within a recess 220 in the first portion 140 and possibly also in the second portion 144 of the handguard 100.

In some embodiments, the clamp 200 includes at least one fastener (e.g., tightening means such as a screw or bolt) that interfaces with the clamp 200. The fastener can include screws, bolts, nuts, rivets, retaining rings, dowl pins, snap fasteners, and the like. In some embodiments, the fastener(s) 210 are screws as shown in FIGS. 4A-4E, and they interface with the clamp 200 by tightening into threaded apertures in the main body 202 of the clamp and causing the upper ends 204 of the projecting lugs to move relative to one another to decrease a distance between the projecting lugs 208 as described herein. For example, as discussed herein, in some embodiments, the projecting deformable lugs 208 interface with other structures to move the lugs 208. As shown in FIGS. 4A and 4B, the projecting deformable lugs 208 extend through the first portion 140 of the handguard 100 so that upper ends 204 of the lugs 208 are at least partially recessed below the concave inner surface 106 of the handguard 100. In this way, the handguard 100 can be initially mounted to the firearm 10 with a minimum of resistance (i.e., before the clamp 200 begins to engage).

As used herein, the term deformable means that the object or material can bend, stretch, compress, or otherwise alter its form in response to applied stress or pressure. In various embodiments, clamp 200 comprises a metal, polymers, silicone, rubber or clay material. In many embodiments, the deformability of the clamp 200 allows the clamp 200 to adapt to irregular or complex shapes, ensuring a more uniform grip and reducing the risk of damage to the object being clamped. For example, in some embodiments, the deformability of clamp 200 helps eliminate gaps between the clamp 200 and the first portion 140 and/or the second portion 144 of the handguard, providing a more secure hold. In addition, in some embodiments, the deformable clamp 200 is configured to be quickly released and/or adjusted without tools for ease in quick assembly and/or disassembly. In many embodiments, the deformable clamp 200 allows for variable pressure distribution within the handguard, which facilitates maintaining a seal in dynamic conditions (such as the moving parts of firearm 10).

In various embodiments, when the handguard 100 is positioned against the magazine tube 22, the upper ends 204 of the lugs 208 (and at least a portion of the deformable arms of the lugs 208) are between the concave inner surface 106 of the handguard and the magazine tube 22. Further, the upper ends 204 of the lugs 208 are positioned at an upper portion of the magazine tube 22 (e.g., at a portion of the magazine tube 22 adjacent to the barrel 20 of the firearm 10 or at a position adjacent to where the magazine tube 22 meets or is closest to the barrel 20 of the firearm 10). In other words, the upper ends 204 of the lugs 208 can be arranged to clamp into a concave gap formed where the magazine tube 22 and the barrel 20 meet (or are closest to each other).

With reference to FIGS. 6A-6G an exemplary embodiment of a clamp is illustrated. In many embodiments, clamp 200 has a main body 202 with at least one pair of projecting deformable lugs 208 extending from the main body 202. In many embodiments, the upper ends 204 of the projecting lugs 208 have a cylindrical shape. However, in other embodiments, the upper ends of the projecting lugs can have a more square- or rectangular-like shape. As discussed herein, in some embodiments, the main body 202 is positioned at least partially within the first portion 140 and in some embodiments at least partially between the first portion 140 and the second portion 144 of the handguard.

Figure 6B:
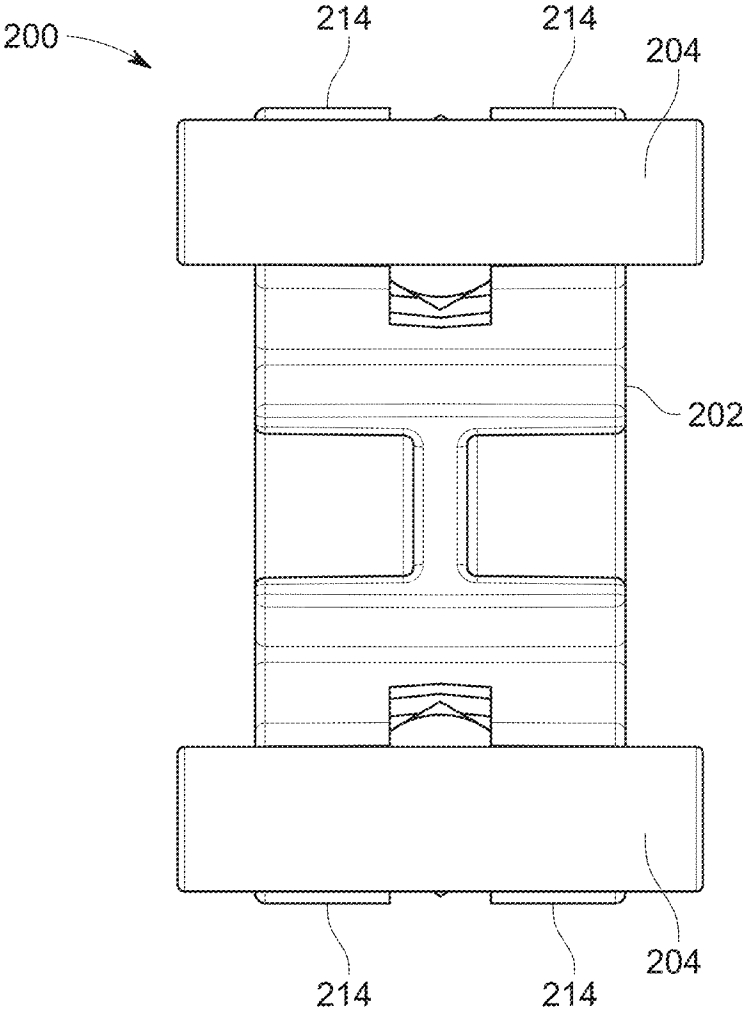
FIG. 6B is a top plan illustrative view thereof.
Figure 6A:
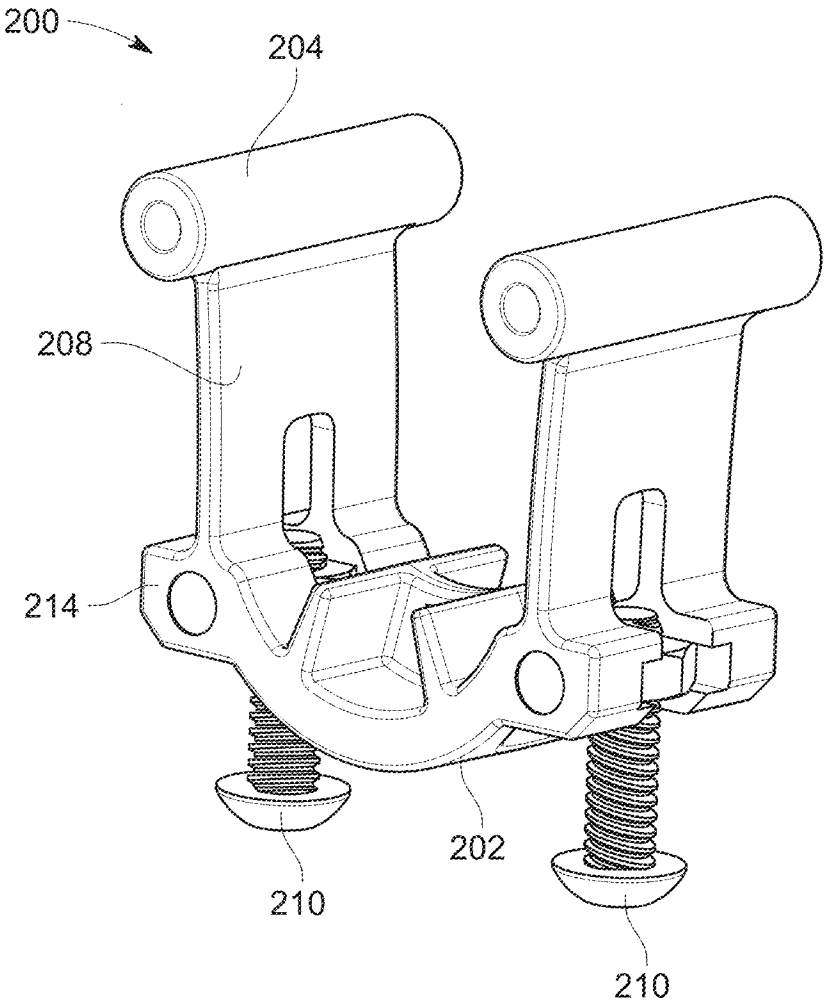
FIG. 6A is an upper, front, left-side perspective illustrative view of an example embodiment of a clamp.
Figure 6C:
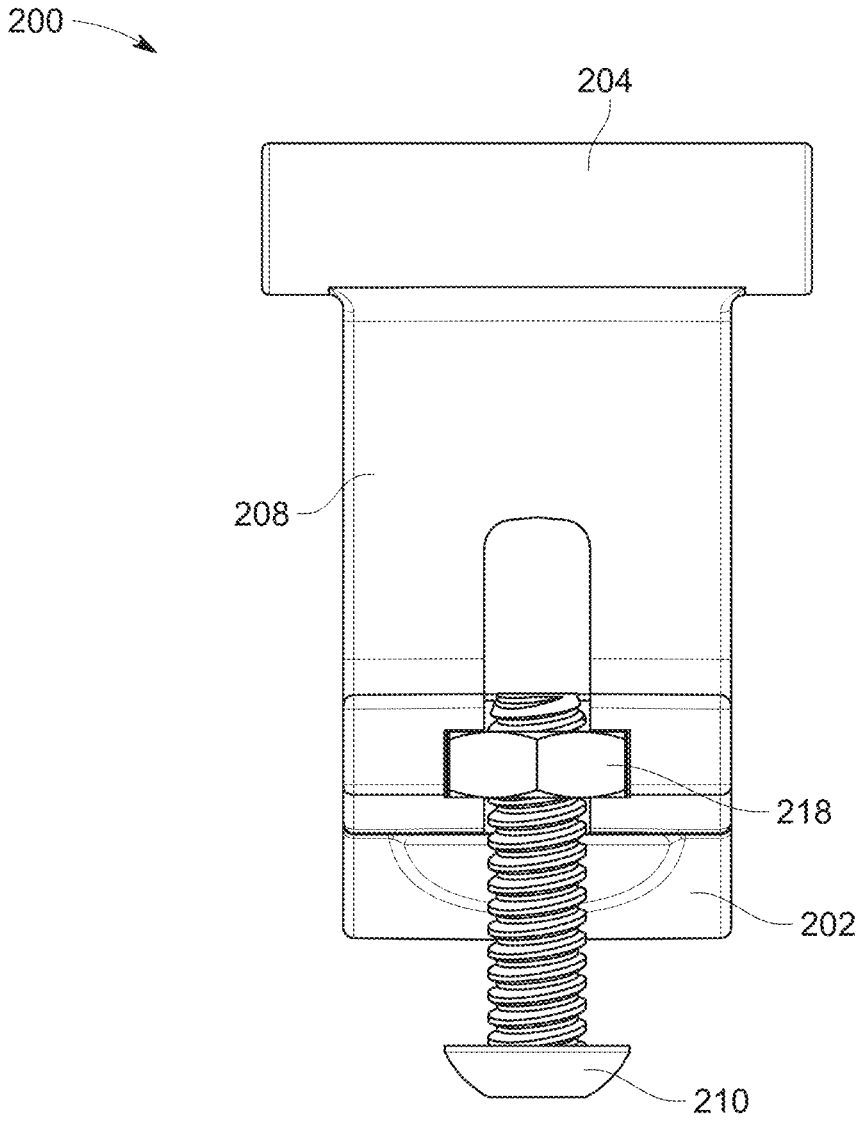
FIG. 6C is a left-side elevation illustrative view thereof.
Figure 6E:
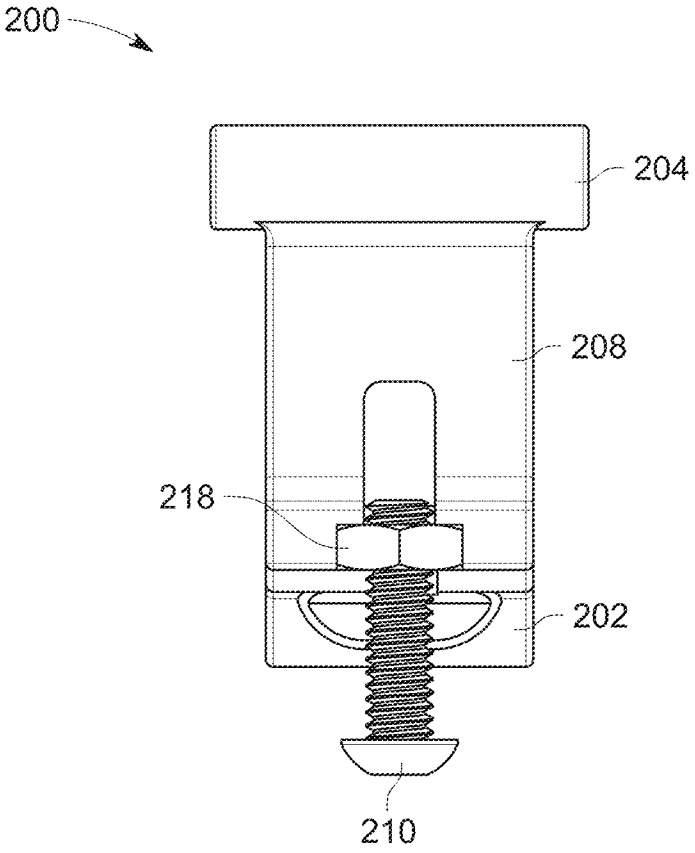
FIG. 6E a right-side elevation illustrative view thereof.
Figure 6D:
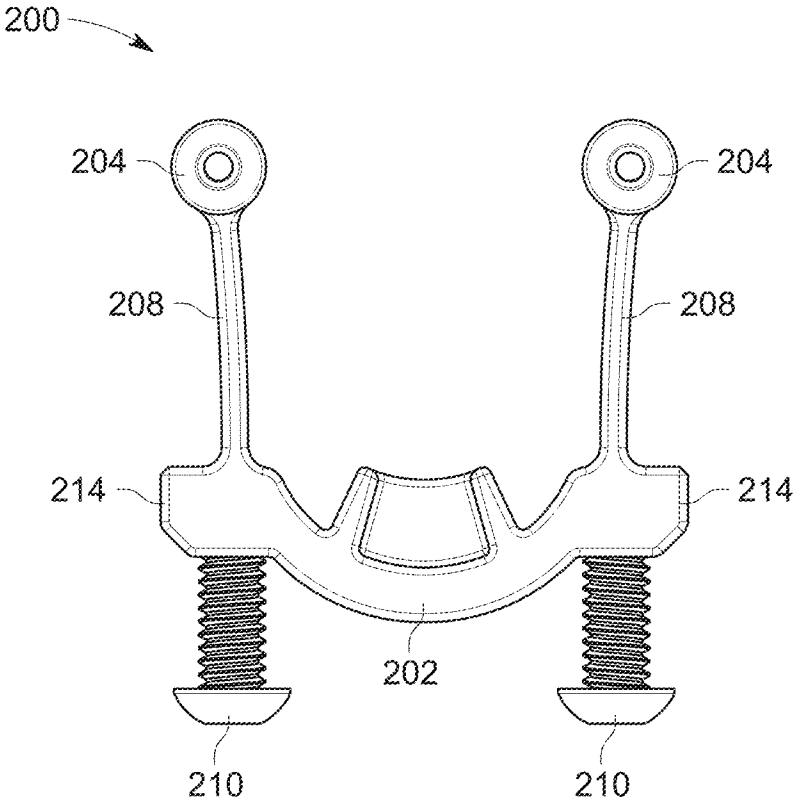
FIG. 6D is a rear end elevation illustrative view thereof.
Figure 6G:
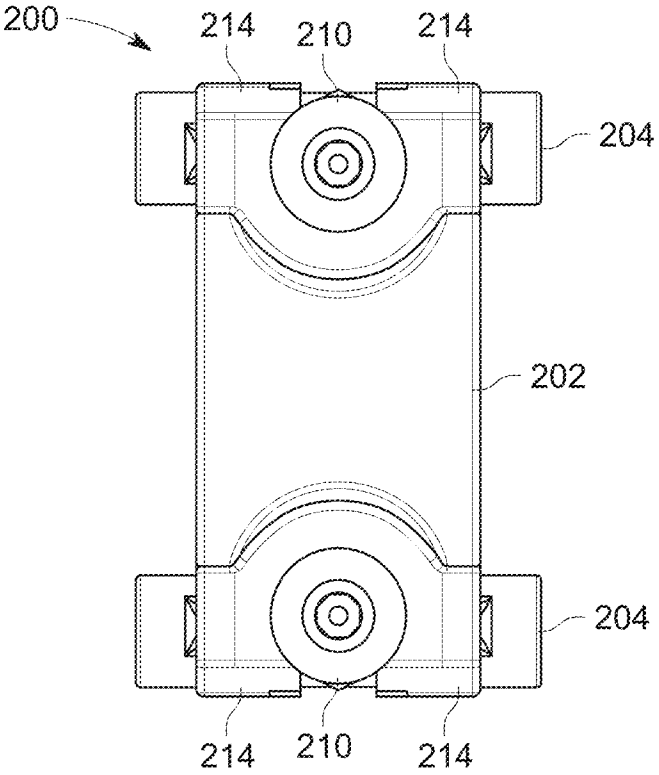
FIG. 6G is a bottom plan illustrative view thereof.
Figure 6F:
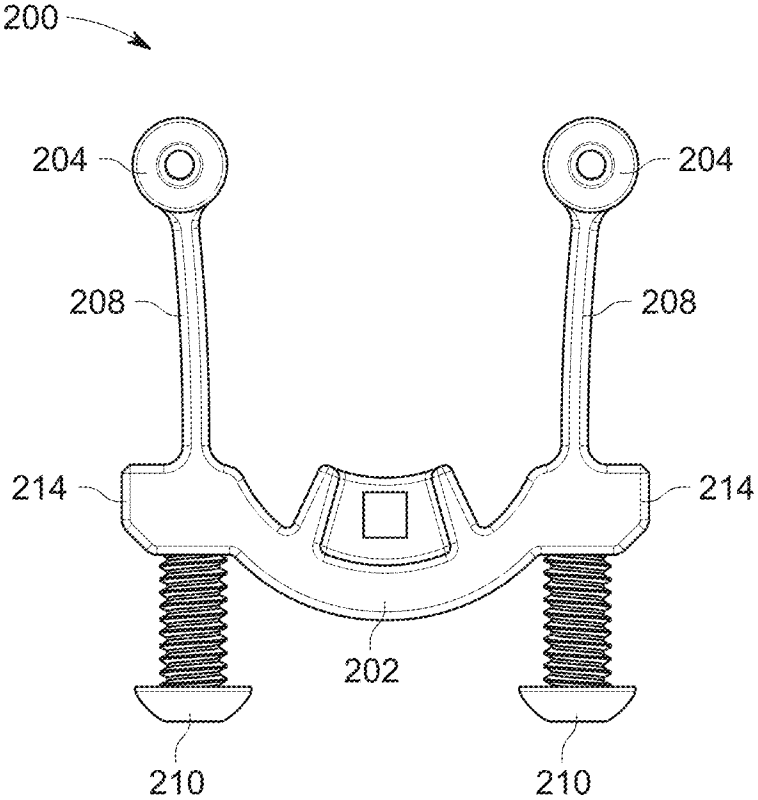
FIG. 6F is a front-end elevation illustrative view thereof.

In some embodiments, the main body 202 of the clamp 200 includes at least one fastener 210 that interfaces with the clamp 200. For example, as illustrated in FIGS. 6A-D, fasteners 210 are two screws that tighten into threaded apertures 218 on main body 202 of clamp 200. In some embodiments, the threaded apertures 218 comprise a nut, for instance as seen in FIGS. 6A, 6C, and 6E.

In various embodiments, the movement of the fasteners 210 (e.g., tightening) causes the upper ends 204 of the projecting lugs 208 to move relative to one another to decrease a distance between the upper ends 204 of the projecting lugs 208 by causing the projecting deformable lugs 208 to deform (e.g., to move the upper end 204 of each projecting lug 208 toward each other and into contact with the magazine tube 22 and/or the magazine tube 22 and the barrel 20 of the firearm 10). In other embodiments, the deformable lugs 208 are configured to contact an upper half of the barrel 20 rather than the magazine tube 22.

As illustrated in, e.g., FIGS. 4A-4E, in some embodiments, the clamp 200 (shown further, e.g., in FIGS. 5A-7E) is positioned between the first portion 140 and the second portion 144 of the handguard 100 (e.g., within a recess 220 between the first portion 140 and the second portion 144). The positioning and configuration of the clamp 200 improves styling of firearm 10, improves styling of components of firearm 10 (such as the handguard 100) and/or provides an improved (e.g., lesser, smaller, etc.) height profile of the handguard 100 in relation to the barrel 20 and magazine tube 22.

In some embodiments, the projectable deformable lugs 208 of clamp 200 define a universal type of connection (e.g., providing one or more mating surfaces that are interchangeable between different firearms) that is configured to receive a magazine tube 22 and/or a barrel 20 advantageously (e.g., with improved speed, simplicity, and an improved low-profile engagement of the handguard 100) when attaching a handguard 100 to various types of firearms.

In some embodiments, one or more components of the handguard 100 (e.g., the first portion 140 and/or the second portion 144) include clearance apertures 212 that align with the fastener(s) 210 in the main body 202 of the clamp 200 such that the fastener(s) 210 are accessible to be tightened through the clearance apertures 212 after the clamp 200 is positioned within the handguard 100 and the handguard 100 is positioned against the magazine tube 22. For example, in some embodiments, the clearance apertures 212 extend through the second portion 144 of the handguard 100 and a allow a tool, such as a screwdriver to pass therethrough.

With reference to FIGS. 5A-5D a main body 202 of the clamp 200 is recessed within the clamp 200 or positioned between the first portion 140 and the second portion 144 (the second portion 144 is not shown in FIGS. 5A-5E) of the handguard 100. For example, in various embodiments, the main body 202 of the clamp 200 is positioned within a recess 220 between the first portion 140 and second portion 144 of the handguard 100. In various embodiments, the recess 220 between (e.g., within one or more of) the first portion 140 and the second portion 144 is positioned such that the projecting deformable lugs 208 extend above the first portion 140 of the handguard so that upper ends 204 of the lugs 208 are interior to the concave inner surface 106 of the handguard when engaged or moving toward engagement with the magazine tube 22 and/or barrel 20. In some embodiments, the first portion 140 has an opening through which a majority, an entirety, or a portion of some or all of components of the clamp 200 are positioned to be adjacent to the magazine tube 22 and/or the barrel 20.

In various embodiments, not all components of the clamp 200 are directly adjacent to the magazine tube 22 and/or the barrel 20. For example, in some embodiments, some of the main body 202 extends into the structure of the first portion 140, such as protrusions 214 shown in FIG. 5E. In some embodiments, parts of the main body 202 (e.g., protrusions 214) are positioned to interface with the first portion 140 and/or the second portion 144 to keep the clamp 200 in position in relation to the handguard 100 as the handguard 100 is installed onto the firearm 10.

For example, with reference to embodiments illustrated in FIGS. 7A-E, in some embodiments, when the handguard 100 is positioned against the magazine tube 22, the upper ends 204 of the lugs 208 (and at least a portion of the deformable arms of the projecting deformable lugs 208) are positioned between the concave inner surface 106 of the handguard and the magazine tube 22. Further, the upper ends 204 of the lugs 208 are positioned at an upper portion of the magazine tube 22 (e.g., at a portion of the magazine tube 22 adjacent to the barrel 20 of the firearm 10 or at a position adjacent to where the magazine tube 22 meets or is closest to the barrel 20 of the firearm 10).

Figure 7B:
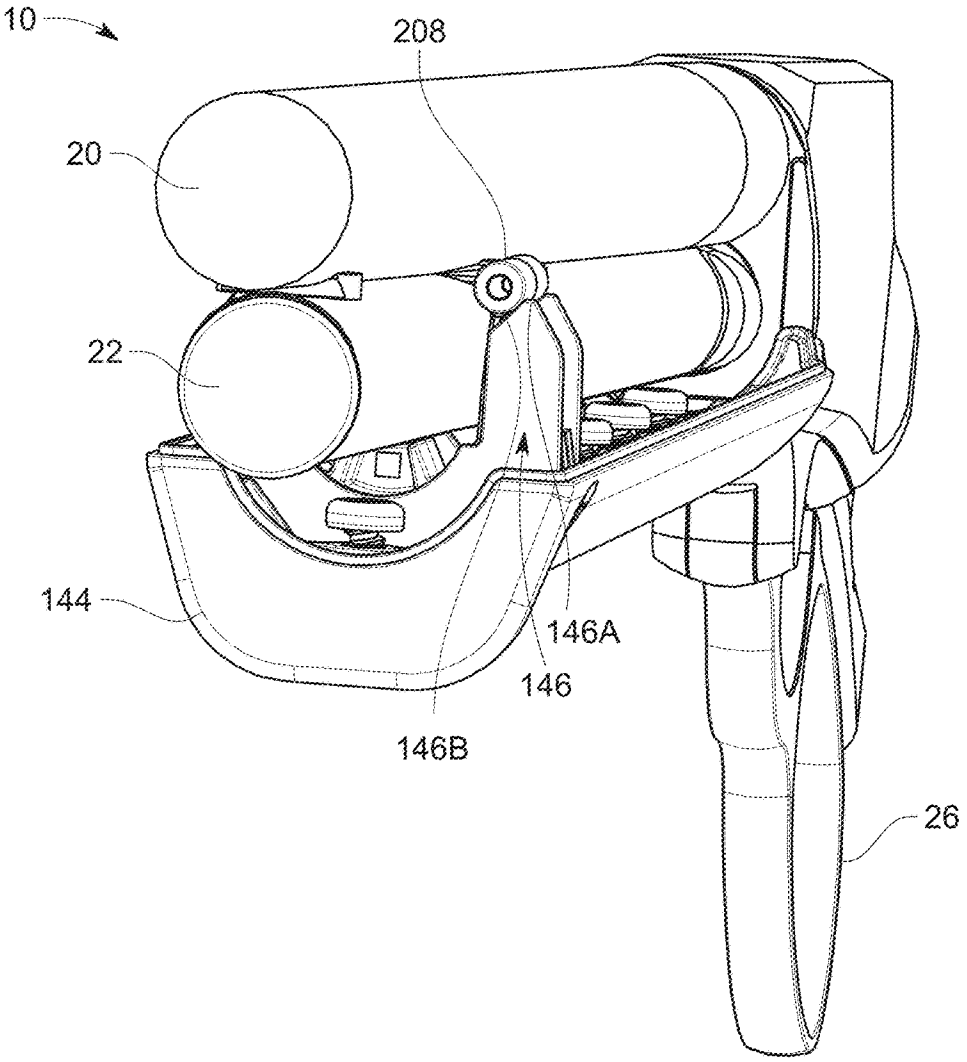
FIG. 7B is an upper front left-side perspective illustrative view of a second portion of the handguard and example embodiment of a clamp in the first position of FIG. 7A.
Figure 7A:
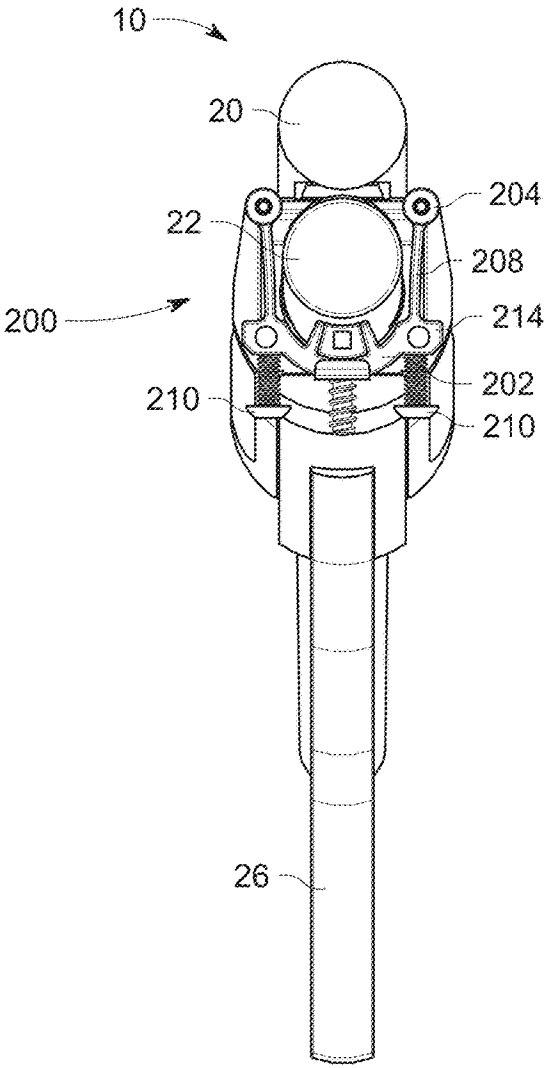
FIG. 7A is a front-end elevation illustrative view of an example embodiment of a handguard and example embodiment of a clamp in a first position.

For example, FIG. 7A is a front-end elevation illustrative view of an embodiment of a handguard 100 and example embodiment of a clamp 200 in a first position. FIG. 7B is an upper front left-side perspective illustrative view of an embodiment of a second portion 144 of the handguard 100 and example embodiment of a clamp 200 in the first position of FIG. 7A.

Figure 7C:
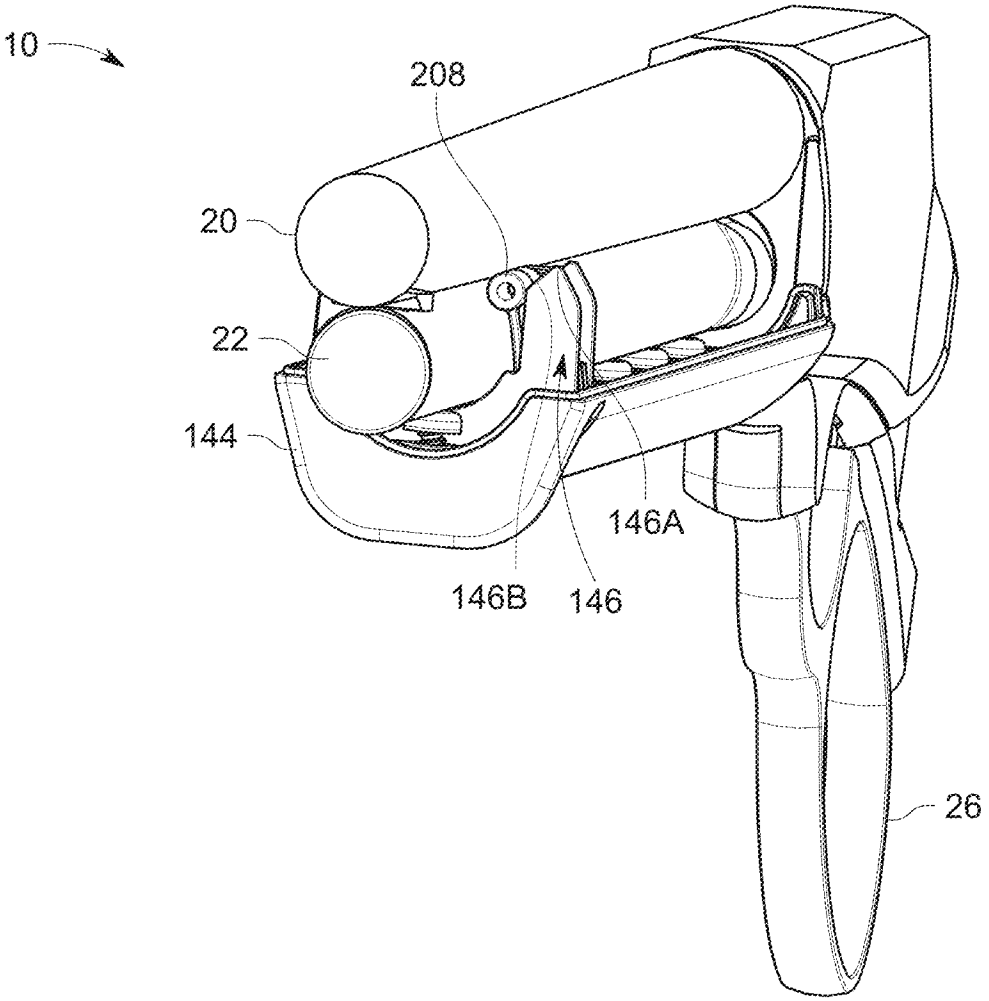
FIG. 7C is an upper front left-side perspective illustrative view of a second portion of the handguard and example embodiment of a clamp in a second position.
Figure 7E:
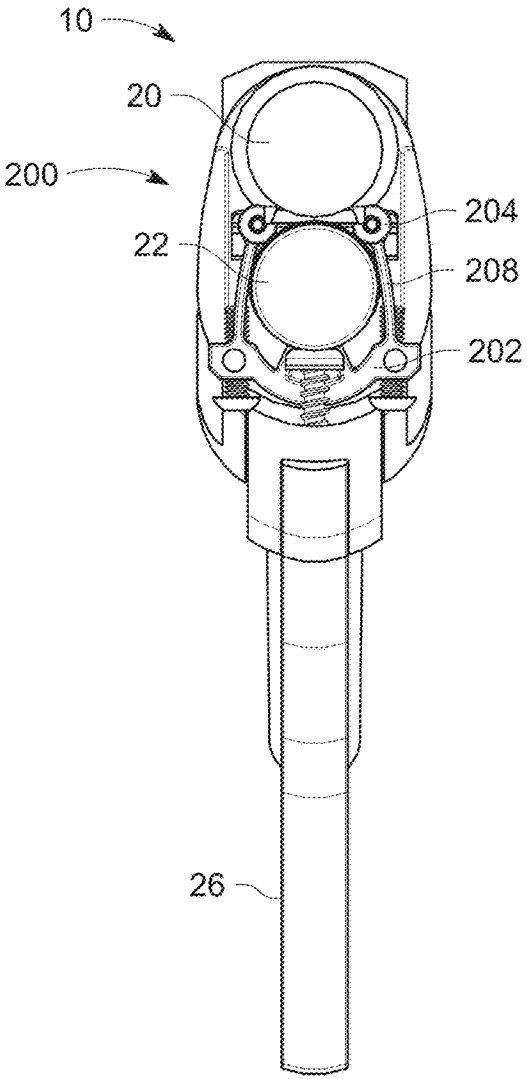
FIG. 7E is a front-end elevation illustrative view of an example embodiment of a handguard and example embodiment of a clamp in the second position of FIGS. 7C and 7D.
Figure 7D:
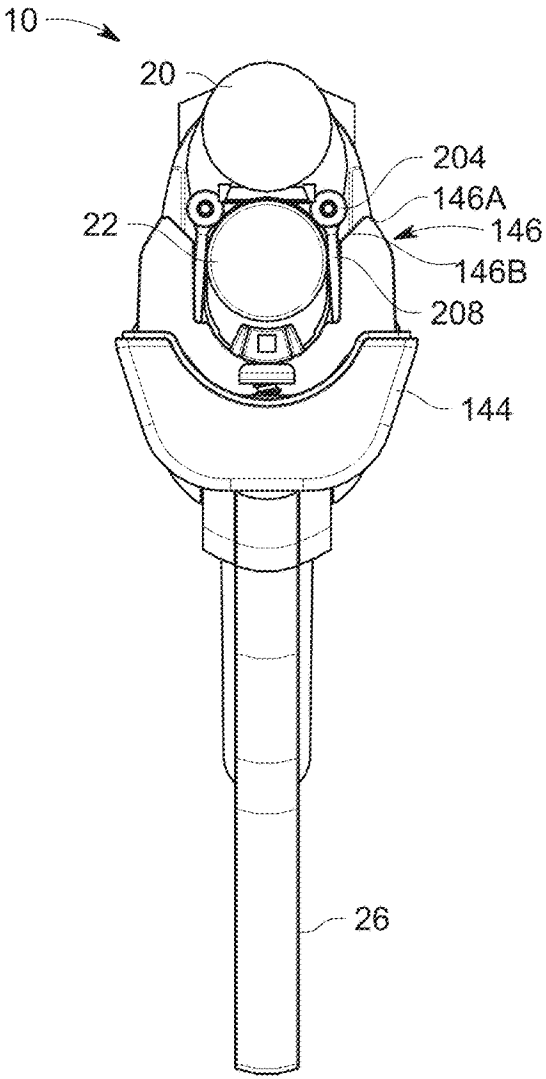
FIG. 7D is a front-end elevation illustrative view of a second portion of the handguard and example embodiment of a clamp in the second position of FIG. 7C.

FIG. 7C is an upper front left-side perspective illustrative view of an embodiment of a second portion 144 of the handguard 100 and example embodiment of a clamp 200 in a second position. FIG. 7D is a front-end elevation illustrative view of an embodiment of a second portion 144 of the handguard 100 and example embodiment of a clamp 200 in the second position of FIG. 7C. FIG. 7E is a front-end elevation illustrative view of an embodiment of a handguard 100 and example embodiment of a clamp 200 in the second position of FIGS. 7C and 7D.

FIGS. 7A and 7B illustrate an embodiment of a first position of a clamp 200 where fastener(s) are not tightened. As discussed herein, in various embodiments, the clamp 200 mounts a forward end of the handguard 100 to the magazine tube 22 when the clamp 200 is manipulated with fastener(s) 210 that move the projecting deformable lugs 208 in a downward and inward direction (e.g., from a first position shown in FIGS. 7A and 7B to a second position as shown in FIGS. 7C, 7D, and 7E) to interface with the magazine tube 22.

For example, turning to FIGS. 7A and 7B, the fasteners 210 are not tightened into the main body 202 of clamp 200 and the upper ends 204 of the lugs 208 are not in a position snug (e.g., tightened) against the magazine tube 22. Similarly, although fastener(s) 210 are not visible in FIG. 7B, in this embodiment, the screws are not tightened into the main body 202 of clamp 200 and the upper ends 204 of the lugs 208 are not in a position snug (e.g., tightened) against the magazine tube 22 in FIG. 7B. In FIG. 7B, only the second portion 144 of the handguard is shown (the first portion 140 is hidden) for illustrative purposes. As illustrated in FIG. 7B, the upper end of lug 208 is not pressed inward by an angled portion 146 of the lower portion 144 of the handguard 100. Although only one side of the clamp, lugs, and angled portion of the components are visible In FIG. 7B, in some embodiments, the configuration of the components is symmetrical (as shown by way of example in FIGS. 7A, 7D, and 7E); thus, both upper ends of the lugs 208 are not pressed inward by angled portions 146 of the lower portion 144 of the handguard 100. In various embodiments, the projecting deformable lugs 208 are in an upward position in FIGS. 7A and 7B (e.g., projecting deformable lugs 208 have not been pulled in a downward motion by tightening of the fasteners 210).

In many embodiments, the angled portions 146 of the lower portion 144 of the handguard 100 have a first edge 146A and a second edge 146B that configure the angle. As shown in an embodiment in FIGS. 7A and 7B, in an untightened configuration (e.g., the fasteners 210 of the clamp 200 not being tightened), the upper ends of the lugs 208 are not directly adjacent to, or in contact with the second edge 146B of the angled portions 146; instead, the upper ends of the lugs 208 are closer to, or in contact with, the first edge 146A of the angled portions 146. In some embodiments of an untightened configuration, the upper ends of the lugs 208 are between the first edge 146A and the second edge 146B of the angled portions 146.

In many embodiments, the angled portions 146 have various configurations. For example, in some embodiments, the angled portions 146 comprise multiple angled portions (e.g., multiple angled portions at each side of the clamp 200). In various embodiments, the angled portions are formed as an integral piece (e.g., a single unified component). In some embodiments, the angled portions 146 are raised above (or extend from) the second portion 144 of the handguard 100. In other embodiments, the angled portions 146 are incorporated into other parts of the structure of the handguard 100.

FIGS. 7C-7E illustrate an embodiment of a second position of a clamp 200 where fastener(s) 210 are tightened. For example, in FIGS. 7C, 7D, and 7E, the fasteners 210 (not visible in FIGS. 7C and 7D) are tightened into the main body 202 of clamp 200 and the upper ends 204 of the lugs 208 are in a position snug (e.g., tightened) against the magazine tube 22. In various embodiments, as the fastener(s) 210 are tightened to move the clamp 200 into the second position, the projecting deformable lugs 208 move down (e.g., bend partially away from the magazine tube 22 and/or deform to bring the upper ends 204 of the lugs 208 towards each other and towards the main body 202 of the clamp 200). In addition, the upper ends 204 of the lugs 208 are pushed towards each other (e.g., towards the magazine tube 22) via contact with the angled portions 146. Said another way, as the fastener(s) 210 are tightened to move the clamp 200 into the second position, the upper ends 204 of the lugs 208 move from a position closer to the first edge 146A to a position closer to the second edge 146B of the angled portions 146. As the fastener(s) 210 are tightened on the clamp 200, the movement of the projecting deformable lugs 208 (e.g., via the movement of the upper ends 204 of the lugs 208 from the first edge 146A towards the second edge 146B) positions the upper ends 204 of the lugs 208 against the magazine tube 22, or against the barrel 20 and the magazine tube 22.

In an exemplary embodiment illustrated in FIGS. 7C, 7D, and 7E, when the fastener(s) 210 are tightened into the main body 202 of the clamp 200, the upper ends 204 of the projecting deformable lugs 208 are in a position snug (e.g., tightened in a downward and inward direction) against the magazine tube 22. In various embodiments, this tightening of the fastener(s) 210 locks the forward end of the handguard 100 to a position against the magazine tube 22.

In various embodiments, the fastener(s) 210 are tightened so that at least some portions of the projecting deformable lugs 208 are in contact with the magazine tube 22 or the magazine tube 22 and the barrel 20. In such embodiments, the clamp 200 secures the handguard 100 to the firearm 10 and prevents movement of the handguard 100 relative to the firearm 10. In some embodiments, not shown, the projecting deformable lugs 208 contact and compress against an upper half of the barrel 20. In some embodiments, once the projecting deformable lugs 208 are in contact with the magazine tube 22, further tightening of the fastener(s) 210 causes the first portion 140 and the second portion 144 of the handguard 100 to be pulled tighter against the magazine tube 22 or increases a compressive force between the first portion 140 and the second portion 144 of the handguard 100. In some embodiments, once the projecting deformable lugs 208 are in contact with the magazine tube 22, further tightening of the fastener(s) 210 pulls the first portion 140 and the second portion 144 of the handguard 100 upward and/or further cinch them against the bottom of the magazine tube 22.

In many embodiments, the clamp 200 improves styling and/or provide an improved (e.g., lesser) height profile of the handguard. In other embodiments, the clamp 200 improves a user experience of connecting a handguard 100 to a firearm 10. For example, in some embodiments the clamp 200 facilitates connecting the handguard 100, which increases the speed of connection. In other embodiments, the clamp 200 improves a height profile of the handguard 100 when mounted to the firearm 10.

Figure 8:
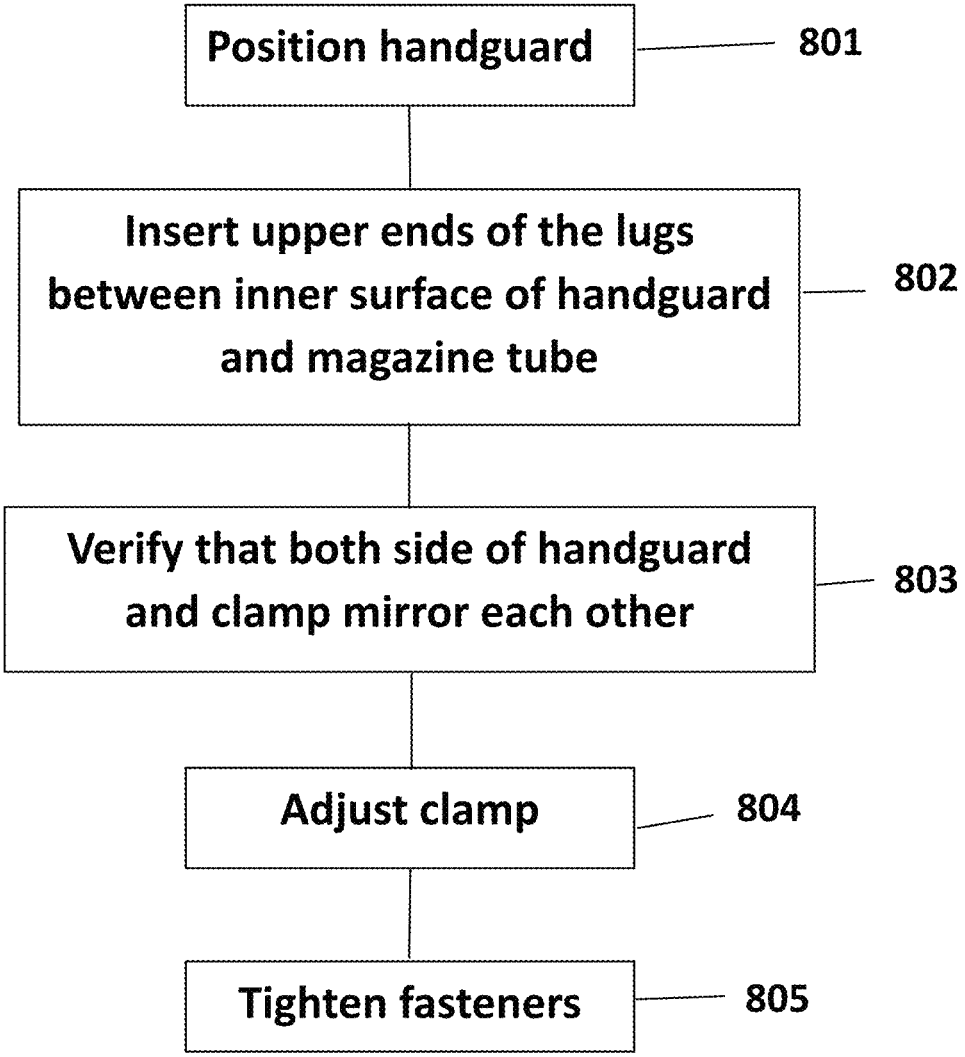
FIG. 8 is an exemplary embodiment of a method in accordance with various embodiments of the invention.

With reference to FIG. 8, an exemplary method 800 of using clamp 200 to connect a handguard 100 to a firearm using a deformable clamp is provided. The embodiments described in method 800 accommodate minor variations in the firearm's geometry, enhancing the overall durability and performance of the firearm. The ability to adjust and secure the handguard without permanent modifications also allows for easy maintenance and customization.

For example, the handguard 100 is first positioned adjacent to the magazine tube 22 of the firearm 10 (step 801). In this embodiment, a user ensures that the concave inner surface 106 of the handguard 100 aligns closely with the exterior surface of the magazine tube 22 to facilitate achieving a snug fit. Next, the upper ends 204 of the lugs 208, along with a portion of the projecting deformable lugs 208, are inserted between the inner surface 106 of the handguard 100 and the magazine tube 22 (step 802). In many embodiments, the lugs 208 are situated at the upper portion of the magazine tube 22, near where it meets or is closest to the barrel 20, as illustrated in FIGS. 7A and 7B, to help balance the components and prevent misalignment or undue stress.

In many embodiments, a method 800 includes a verification step (step 803), to verify that the configuration is symmetrical, and that both sides of the handguard 100 and clamp 200 mirror each other. For example, symmetry of both sides of the handguard 100 and clamp 200 helps in distributing pressure evenly and maintaining a balanced assembly. In many embodiments, and as illustrated in FIGS. 7A and 7B, the fasteners 210 securing the clamp are not yet tightened. In this initial, untightened state, the upper ends 204 of the lugs 208 are not in tight contact with the magazine tube 22, allowing for adjustments before finalizing the attachment (step 804). For example, in various embodiments, the user ensures that the upper ends 204 of the lugs 208 are not pressed inward by the angled portions 146 of the handguard's lower portion 144. In such embodiments, the lugs 208 remain positioned closer to the first edge 146A of the angled portions 146, providing space for deformation during the tightening process.

In various embodiments, the fasteners 210 are gradually tightened into the main body 202 of the clamp 200 (step 805). This action, depicted in an embodiment illustrated in FIGS. 7C through 7E, pulls the clamp 200, and thus the upper ends 204 of the lugs 208 downward, which upon pressing against the angled portions 146, presses the upper ends 204 inward as they travel downward, causing the upper ends 204 to press against and pull down on the magazine tube 22 (and/or press against the barrel 20). This tightening deforms the lugs 208, compressing them against the magazine tube 22, creating a secure interface. The lugs 208 transition from a position near the first edge 146A to one closer to the second edge 146B of the angled portions 146, securing a firm grip on the magazine tube 22. In many embodiments, the tightening of the fastener(s) 210 comprises tightening screws into threaded apertures 218 in the main body of the clamp 200, causing the upper ends 204 of the projecting deformable lugs 208 to contact both the magazine tube 22 and the barrel 20 to securely attach the handguard 100 to the firearm 10.

In many embodiments, the fasteners 210 are then further tightened, so that the upper ends 204 of the lugs 208 are snug against the magazine tube 22. For example, in many embodiments, the tightening includes fully moving the clamp 200 into its second position, firmly holding the handguard 100 in place and preventing any unwanted movement.

Although this disclosure shows and describes two fasteners 210, in other embodiments, a single fastener, or more than two fasteners could be used with similar effect.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A firearm comprising:

a barrel;

a tube disposed below the barrel;

a handguard configured to be mounted adjacent to the barrel and the tube, the handguard comprising a first portion and a second portion;

a clamp positioned between the first portion and the second portion of the handguard, the clamp comprising:

a main body positioned within a recess between the first portion and the second portion of the handguard;

at least one pair of projecting deformable lugs extending from the main body, each lug having an upper end; and at least one fastener configured to tighten into the main body of the clamp, thereby causing the upper ends of the projecting deformable lugs to move toward each other;

wherein the upper ends of the projecting deformable lugs are positioned between a concave inner surface of the handguard and the tube, and are configured to contact the tube when the at least one fastener is tightened.

2. The firearm of claim 1, wherein the first portion of the handguard comprises a substantially arcuate upper surface configured to conform to a lower surface of the barrel.

3. The firearm of claim 1, wherein the upper ends of the projecting deformable lugs are cylindrical in shape and move inward and downward to contact the tube and secure the handguard to the firearm.

4. The firearm of claim 1, wherein the first portion of the handguard comprises a longitudinal bore configured to receive the tube, and the projecting deformable lugs of the clamp extend through the first portion of the handguard, positioning the upper ends of the projecting deformable lugs interior to the concave inner surface of the handguard.

5. The firearm of claim 1, wherein the handguard further comprises a first portion and a second portion, the first portion having a concave inner surface configured to conform to a lower surface of the barrel, and the second portion configured to couple to the first portion.

6. The firearm of claim 5, wherein the main body of the clamp is positioned within a recess between the first portion and the second portion of the handguard.

7. The firearm of claim 5, wherein the second portion comprises angled portions having a first edge and a second edge, the first edge and the second edge defining an angle.

8. The firearm of claim 7, wherein the upper ends of the projecting deformable lugs are positioned between the first edge and the second edge of the angled portions.

9. The firearm of claim 8, wherein the projecting deformable lugs are configured to move inwardly and downwardly when the at least one fastener is tightened, thereby engaging with the angled portions.

10. The firearm of claim 1, wherein the at least one fastener is accessible through clearance apertures in the handguard, allowing the at least one fastener to be tightened after the clamp is positioned within the handguard and the handguard is mounted on the firearm.

11. The firearm of claim 1, wherein the projecting deformable lugs are configured to contact both the tube and the barrel when the at least one fastener is tightened.

12. A clamp for securing a handguard to a firearm, the firearm comprising a barrel and a tube, the clamp comprising:

a main body configured to be positioned within a recess of the handguard;

at least one pair of projecting deformable lugs extending from the main body, each lug having an upper end; and at least one fastener configured to interface with the main body and cause the upper ends of the projecting deformable lugs to move relative to one another and decrease a distance between the upper ends;

wherein the upper ends of the projecting deformable lugs are configured to contact the tube when the at least one fastener is tightened, thereby securing the handguard to the firearm.

13. The clamp of claim 12, wherein the at least one fastener comprises a screw that tightens into at least one threaded aperture in the main body of the clamp, and the projecting deformable lugs are configured to deform inward and downward as the at least one fastener is tightened.

14. The clamp of claim 12, wherein the upper ends of the projecting deformable lugs have a cylindrical shape, and are positioned to be between a concave inner surface of the handguard and the tube when installed on the firearm.

15. The clamp of claim 12, wherein the main body of the clamp includes at least one clearance aperture that aligns with the at least one fastener, allowing the at least one fastener to be tightened through the at least one clearance aperture when the clamp is positioned within the handguard.

16. The clamp of claim 12, wherein the projecting deformable lugs include a material comprising at least one of a metal, a polymer, a silicone, a rubber, a clay, and an elastomer.

* * * * *